US010416587B2

(12) United States Patent
Ohazama

(10) Patent No.: US 10,416,587 B2
(45) Date of Patent: Sep. 17, 2019

(54) AUXILIARY CHARGING DEVICE FOR AN IMAGE FORMING APPARATUS

(71) Applicant: FUJI XEROX CO., LTD., Tokyo (JP)

(72) Inventor: Kazuyasu Ohazama, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/916,458

(22) Filed: Mar. 9, 2018

(65) Prior Publication Data

US 2019/0079424 A1 Mar. 14, 2019

(30) Foreign Application Priority Data

Sep. 12, 2017 (JP) ..... 2017-174497

(51) Int. Cl.
*G03G 15/02* (2006.01)
*G03G 15/00* (2006.01)

(52) U.S. Cl.
CPC ..... *G03G 15/0216* (2013.01); *G03G 15/0275* (2013.01); *G03G 15/0291* (2013.01); *G03G 15/5054* (2013.01)

(58) Field of Classification Search
CPC ..... G03G 15/0275; G03G 15/0266; G03G 15/0216; G03G 15/0291
See application file for complete search history.

(56) References Cited

U.S. PATENT DOCUMENTS 5,923,920 A * 7/1999 Ishida ..... G03G 15/0266 399/45

FOREIGN PATENT DOCUMENTS

| | | | | |
|---|---|---|---|---|
| JP | 4-102881 A | | 4/1992 | |
| JP | 07043981 A | * | 2/1995 | ..... C03B 19/1415 |
| JP | 08305128 A | * | 11/1996 | |
| JP | 2003091135 A | * | 3/2003 | |

* cited by examiner

*Primary Examiner* — Benjamin R Schmitt
*Assistant Examiner* — Milton Gonzalez
(74) *Attorney, Agent, or Firm* — Sughrue Mion, PLLC

(57) ABSTRACT

A charging device includes a first charging unit and a second charging unit. The first charging unit electrostatically charges a surface of an image bearing member that comes into contact with a medium onto which an image is to be ultimately transferred. The first charging unit is disposed in correspondence with an entire region of the image bearing member in a first scanning direction. The second charging unit is disposed in an overlapping region where a non-passing region of a small-width medium and a passing region of a maximum-usable-width medium overlap when viewed in the first scanning direction. The small-width medium has a width smaller than a maximum usable width of the maximum-usable-width medium. The second charging unit electrostatically charges the overlapping region.

5 Claims, 12 Drawing Sheets

AUXILIARY CHARGING DEVICE FOR AN IMAGE FORMING APPARATUS

CROSS-REFERENCE TO RELATED APPLICATIONS

This application is based on and claims priority under 35 USC 119 from Japanese Patent Application No. 2017-174497 filed Sep. 12, 2017.

BACKGROUND

Technical Field

The present invention relates to charging devices and image forming apparatuses.

SUMMARY

According to an aspect of the invention, there is provided a charging device including a first charging unit and a second charging unit. The first charging unit electrostatically charges a surface of an image bearing member that comes into contact with a medium onto which an image is to be ultimately transferred. The first charging unit is disposed in correspondence with an entire region of the image bearing member in a first scanning direction. The second charging unit is disposed in an overlapping region where a non-passing region of a small-width medium and a passing region of a maximum-usable-width medium overlap when viewed in the first scanning direction. The small-width medium has a width smaller than a maximum usable width of the maximum-usable-width medium. The second charging unit electrostatically charges the overlapping region.

BRIEF DESCRIPTION OF THE DRAWINGS

Exemplary embodiments of the present invention will be described in detail based on the following figures, wherein.

DETAILED DESCRIPTION

Figure 1:
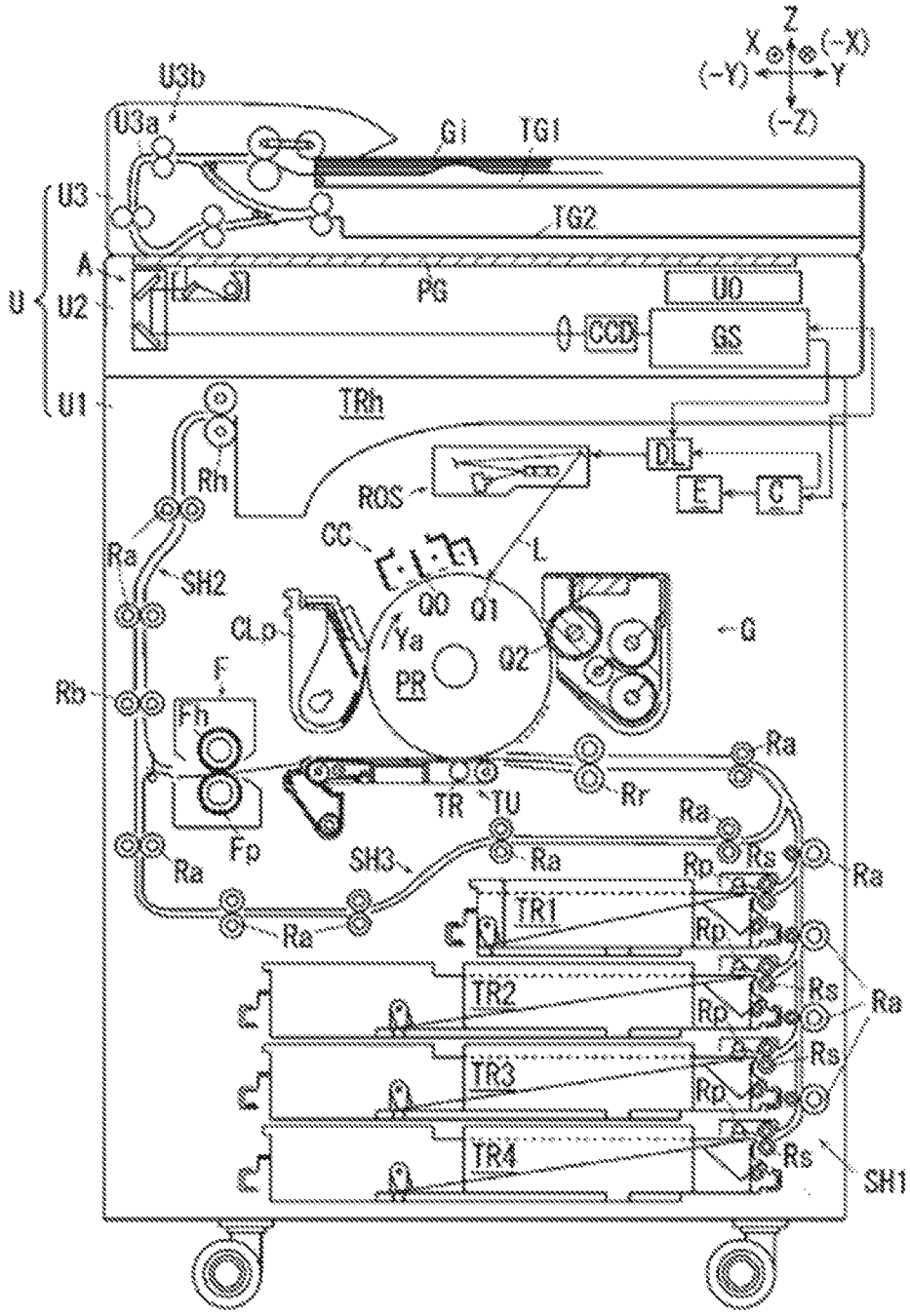
FIG. 1 illustrates an image forming apparatus according to a first exemplary embodiment of the present invention.

Although specific exemplary embodiments of the present invention will be described below with reference to the drawings, the present invention is not to be limited to the following exemplary embodiments.

In order to provide an easier understanding of the following description, the front-rear direction will be defined as "X-axis direction" in the drawings, the left-right direction will be defined as "Y-axis direction", and the up-down direction will be defined as "Z-axis direction". Moreover, the directions or the sides indicated by arrows X, -X, Y, -Y, Z, and -Z are defined as forward, rearward, rightward, leftward, upward, and downward directions, respectively, or as front, rear, right, left, upper, and lower sides, respectively.

Furthermore, in each of the drawings, a circle with a dot in the center indicates an arrow extending from the far side toward the near side of the plane of the drawing, and a circle with an "x" therein indicates an arrow extending from the near side toward the far side of the plane of the drawing.

In the drawings used for explaining the following description, components other than those for providing an easier understanding of the description are omitted where appropriate.

First Exemplary Embodiment

FIG. 1 illustrates an image forming apparatus according to a first exemplary embodiment of the present invention.

In FIG. 1, a copier U as an example of the image forming apparatus according to the first exemplary embodiment is an example of a recording unit and has a printer unit U1 as an example of an image recording device. A scanner unit U2 as an example of a reading unit as well as an example of an image reading device is supported at the upper portion of the printer unit U1. An auto feeder U3 as an example of a document transport device is supported at the upper portion of the scanner unit U2. The scanner unit U2 according to the first exemplary embodiment supports a user interface U0 as an example of an input unit. An operator may input information to the user interface U0 so as to operate the copier U.

A document tray TG1 as an example of a medium container is disposed at the upper portion of the auto feeder U3. The document tray TG1 is capable of accommodating a stack of multiple documents Gi to be copied. A document output tray TG2 as an example of a document output unit is provided below the document tray TG1. Document transport rollers U3*b* are arranged along a document transport path U3*a* between the document tray TG1 and the document output tray TG2.

Platen glass PG as an example of a transparent document table is disposed at the upper surface of the scanner unit U2. In the scanner unit U2 according to the first exemplary embodiment, a reading optical system A is disposed below the platen glass PG. The reading optical system A according to the first exemplary embodiment is supported in a movable manner in the left-right direction along the lower surface of the platen glass PG. Normally, the reading optical system A is in a stopped state at an initial position shown in FIG. 1.

An imaging element CCD as an example of an imaging member is disposed to the right of the reading optical system A. The imaging element CCD is electrically connected to an image processor GS.

The image processor GS is electrically connected to a write circuit DL of the printer unit U1. The write circuit DL is electrically connected to an exposure device ROS as an example of a latent-image forming device.

A photoconductor drum PR as an example of an image bearing member is disposed in the printer unit U1. The photoconductor drum PR is surrounded by a charging device CC, a developing device G, a transfer unit TU as an example of a transfer device, and a drum cleaner CLp as an example of a cleaning unit.

Feed trays TR1 to TR4 as an example of medium containers are disposed below the transfer unit TU. A transport path SH1 extends from each of the feed trays TR1 to TR4. A pickup roller Rp as an example of a medium pickup member, a separation roller Rs as an example of a separation member, a transport roller Ra as an example of a transport member, and a registration roller Rr as an example of a delivery member are disposed in each transport path SH1.

A fixing device F having a heating roller Fh and a pressure roller Fp is disposed to the left of the transfer unit TU. The fixing device F and an output tray TRh are connected by an output path SH2. The output path SH2 and the registration roller Rr are connected by an inversion path SH3. A transport roller Rb, which is rotatable in forward and reverse directions, and an output roller Rh are disposed in the output path SH2.

Image Forming Operation

The multiple documents Gi accommodated in the document tray TG1 sequentially pass over a document read position on the platen glass PG and are output onto the document output tray TG2.

In a case where copying is to be performed by transporting the documents Gi automatically by using the auto feeder U3, the documents Gi sequentially passing over the read position on the platen glass PG are exposed to light with the reading optical system A maintained in the stopped state at the initial position.

In a case where copying is to be performed by allowing the operator to manually place a document Gi on the platen glass PG, the reading optical system A moves in the left-right direction so that the document Gi on the platen glass PG is scanned while being exposed to light.

Reflected light from the document Gi travels through the reading optical system A and is focused onto the imaging element CCD. The imaging element CCD converts the reflected light from the document Gi focused on an imaging surface thereof into electric signals.

The image processor GS converts the read signals input from the imaging element CCD into digital image signals and outputs the digital image signals to the write circuit DL of the printer unit U1. The write circuit DL outputs a control signal according to the input image write signals to the exposure device ROS.

The exposure device ROS outputs a laser beam L so as to form a latent image on the surface of the photoconductor drum PR electrostatically charged by the charging device CC. The latent image on the surface of the photoconductor drum PR is developed into a visible image by the developing device G. A transfer roller TR of the transfer unit TU transfers the visible image on the surface of the photoconductor drum PR onto a recording sheet S as an example of a medium transported along one of the transport paths SH1. The visible image transferred onto the recording sheet S is fixed thereto by the fixing device F. If the recording sheet S passing through the fixing device F is to undergo duplex printing, the recording sheet S is transported to the inversion path SH3. If the recording sheet S is to be output onto the output tray TRh, the recording sheet S is output by the output roller Rh.

Charging Device

Figure 2:
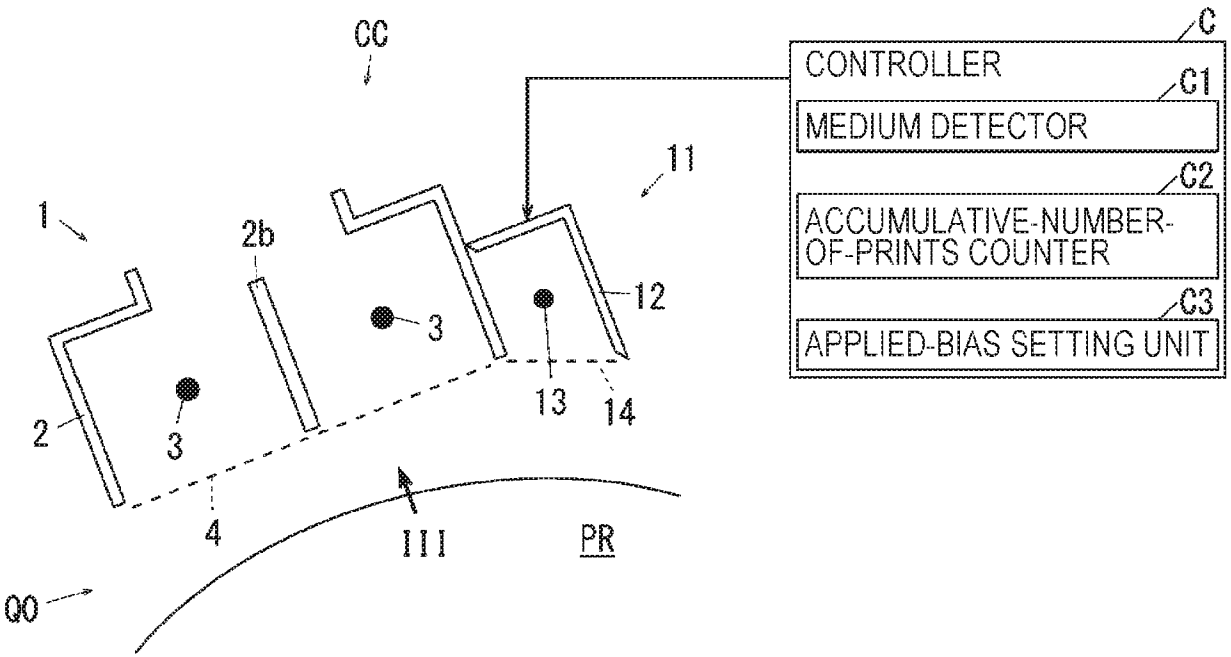
FIG. 2 illustrates a charging device according to the first exemplary embodiment.

FIG. 2 illustrates the charging device CC according to the first exemplary embodiment.

Figure 3:
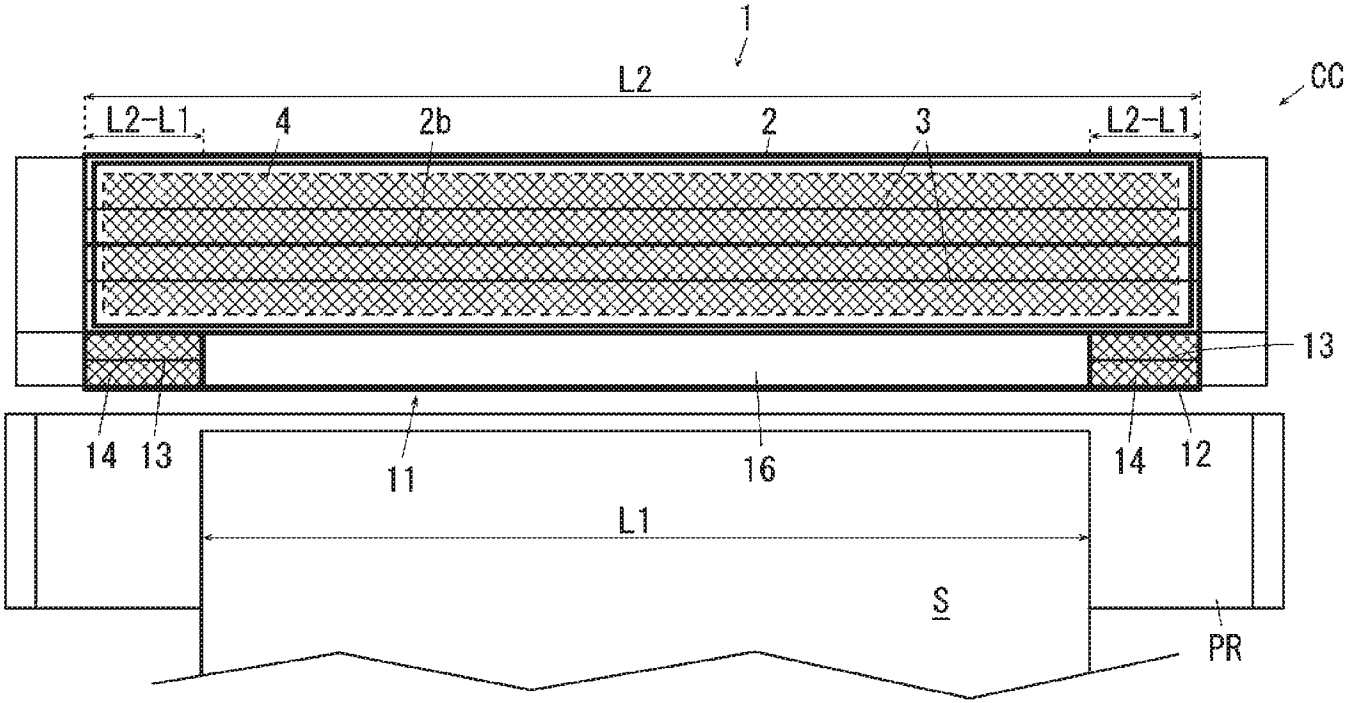
FIG. 3 is a diagram as viewed from the direction of an arrow III in FIG. 2.

FIG. 3 is a diagram as viewed from the direction of an arrow III in FIG. 2.

Referring to FIGS. 1 to 3, the charging device CC according to the first exemplary embodiment has a first charging unit 1. The first charging unit 1 according to the first exemplary embodiment has a shield 2 as an example of a housing. The shield 2 has a shape of a box extending in the width direction of the recording sheet S, which is a first scanning direction as well as the axial direction of the photoconductor drum PR. The photoconductor drum PR side of the shield 2 is open. A partition 2*b* that partitions the space inside the shield 2 is disposed therein. Discharge wires 3 as an example of string-shaped discharging members are disposed inside the shield 2. The discharge wires 3 are respectively disposed in two chambers partitioned from each other by the partition 2*b*. A grid electrode 4 as an example of an electrode is disposed at the photoconductor drum PR side of the shield 2. The grid electrode 4 has a mesh configuration.

Therefore, the first charging unit 1 according to the first exemplary embodiment is constituted of a scorotron as an example of a discharge-type charging unit that electrostatically charges the surface of the photoconductor drum PR in a noncontact manner. Thus, electric discharge occurs when a charge bias is applied between the discharge wires 3 and the shield 2 or the grid electrode 4, whereby the surface of the photoconductor drum PR is electrostatically charged. The charge bias is applied via a power supply circuit E under the control of a controller C.

Referring to FIGS. 2 and 3, an auxiliary charging unit 11 as an example of a second charging unit is disposed downstream of the first charging unit 1 in the rotational direction of the photoconductor drum PR. The auxiliary charging unit 11 similarly has an auxiliary shield 12 as an example of a housing, an auxiliary discharge wire 13 as an example of a string-shaped discharging member, and an auxiliary grid electrode 14 as an example of an electrode. Specifically, the auxiliary charging unit 11 is similarly constituted of a so-called scorotron.

Referring to FIG. 3, the auxiliary grid electrode 14 in the auxiliary charging unit 11 is disposed to face the photoconductor drum PR only at the ends thereof in the first scanning direction, and a cover plate 16 as an example of a cover is disposed in the mid region of the auxiliary grid electrode 14 in the first scanning direction. A length L1 of the cover plate 16 in the first scanning direction is set to be smaller than a chargeable width L2 of the charging device CC. The cover plate 16 is connected to ground so that even when electric discharge from the auxiliary discharge wire 13 occurs, the electric charge flows to the ground via the cover plate 16.

In the copier U according to the first exemplary embodiment, a medium with the maximum usable width is set to a B4-size sheet as an example, and the chargeable width L2 is set to the width over which the entire B4-size sheet is chargeable. In the first exemplary embodiment, the length L1 of the cover plate 16 in the first scanning direction is set in correspondence with the width of an A4-size recording sheet S as an example of a medium with a width smaller than that of a B4-size sheet, and is set to be slightly larger than the width of the recording sheet S. In the first exemplary embodiment, it is assumed that an A4-size sheet is the most frequently used recording sheet S.

Therefore, when viewed in the first scanning direction, the auxiliary charging unit 11 according to the first exemplary embodiment has the auxiliary grid electrode 14 disposed in regions (L2–L1) where non-passing regions (outside the width L1) of a recording sheet S (i.e., an A4-side sheet) having a smaller width than a recording sheet S of a maximum usable width (i.e., a B4-size sheet) and a passing region (i.e., the width L2 region) of the recording sheet S with the maximum width overlap each other. Accordingly, the auxiliary charging unit 11 is capable of electrostatically charging the overlapping regions (L2–L1).

The bias to be applied to the auxiliary charging unit 11 is controlled by the controller C. The controller C has an input/output interface I/O used for, for example, receiving and outputting signals from and to the outside. Furthermore, the controller C has a read-only memory (ROM) that stores, for example, programs and information used for performing processes. The controller C also has a random access memory (RAM) for temporarily storing data. Moreover, the controller C has a central processing unit (CPU) that performs a process according to a program stored in, for example, the ROM. Therefore, the controller C according to the first exemplary embodiment is constituted by a small-size information processing device, that is, a so-called microcomputer. Accordingly, the controller C is capable of realizing various functions by executing the programs stored in, for example, the ROM.

The controller C according to the first exemplary embodiment has the following functions.

A medium detector Cl detects the size of a recording sheet S to be used in the image forming operation. In the first exemplary embodiment, the sizes of recording sheets S accommodated in the feed trays TR1 to TR4 are registered in advance, and the size of recording sheets S to be used is detected based on one of the feed trays TR1 to TR4 from which the sheets are to be fed during the image forming operation and information about the registered size of the recording sheets S.

An accumulative-number-of-prints counter C2 counts the accumulative number of prints in a case where recording sheets S having a width smaller than that of recording sheets S of the maximum size (i.e., B4-size sheets) are used. In this case, the number of printed recording sheets S (A4-size sheets) whose non-passing-region width corresponds to the length of the auxiliary charging unit 11 is counted. In other words, the number of recording sheets S having the size assumed to be used most frequently is counted.

An applied-bias setting unit C3 sets an auxiliary charge bias to be applied to the auxiliary charging unit 11 based on the accumulative number of prints. In the first exemplary embodiment, the auxiliary charge bias is measured in advance based on, for example, tests in accordance with the accumulative number of prints and is registered as information. Specifically, the degree of temporal degradation of the photoconductor drum PR is estimated based on the accumulative number of prints, and the auxiliary charge bias is measured in advance based on, for example, tests in accordance with the degree of temporal degradation of the photoconductor drum PR in the first exemplary embodiment. Because the bias necessary for electrostatic charging increases as degradation progresses, the auxiliary charge bias is set to increase with increasing accumulative number of prints. Therefore, the applied-bias setting unit C3 according to the first exemplary embodiment sets the auxiliary charge bias based on the registered information and the accumulative number of prints.

Operation of First Exemplary Embodiment

In the copier U according to the first exemplary embodiment having the above-described configuration, the surface of the photoconductor drum PR is electrostatically charged by the charging device CC before a latent image is formed on the surface. In this case, the entire charge region (L2) of the photoconductor drum PR in the width direction is electrostatically charged by the first charging unit 1 disposed upstream in the rotational direction of the photoconductor drum PR. Moreover, the widthwise end regions (L2–L1) are electrostatically charged by the downstream auxiliary charging unit 11.

The exposure device ROS forms a latent image on the electrostatically-charged surface of the photoconductor drum PR. The latent image is developed by the developing device G and is transferred onto a recording sheet S by the transfer roller TR.

In a case where the recording sheet S is an A4-size sheet, when the image is to be transferred onto the recording sheet S from the photoconductor drum PR, the ends of the photoconductor drum PR corresponding to a B4-size recording sheet S protrude outward from the edges of the A4-size recording sheet S. Specifically, the overlapping regions (L2–L1) face the transfer roller TR without the recording sheet S interposed therebetween. Thus, electric current from the transfer roller TR is applied to the photoconductor drum PR.

A commonly-used photoconductor drum PR is constituted by stacking a charge generating layer and a charge transport layer over the surface of an aluminum or iron core. When the transfer roller TR and the photoconductor drum PR directly face each other, the electric current from the transfer roller TR flows into the charge transport layer of the photoconductor drum PR, presumably causing the resin strength of the charge transport layer to decrease. This may be problematic in that the photoconductor drum PR may abrade quicker in the end regions (L2–L1) than in the region L1 of the recording sheet S.

It is widely known that a charge transport layer contains polycarbonate (PC) as an example of a first material. However, a photoconductor drum that uses polycarbonate as a charge transport layer especially abrades quickly.

Therefore, when an image forming operation is performed by using recording sheets S having a width smaller than that of a maximum-size sheet, the ends (L2–L1) of the photoconductor drum PR abrade unevenly over time.

Some charge transport layers have a protection layer or an overcoat layer over the surface thereof. Although abrasion is reduced when a protection layer is provided, as compared with a case where a protection layer is not provided, the ends still abrade similarly due to the electric current flowing into the charge transport layer. Therefore, a photoconductor drum PR having a protection layer is applicable in the exemplary embodiment of the present invention. In other words, a photoconductor drum PR not provided with a protection layer abrades quicker at the ends thereof.

Figure 4A:
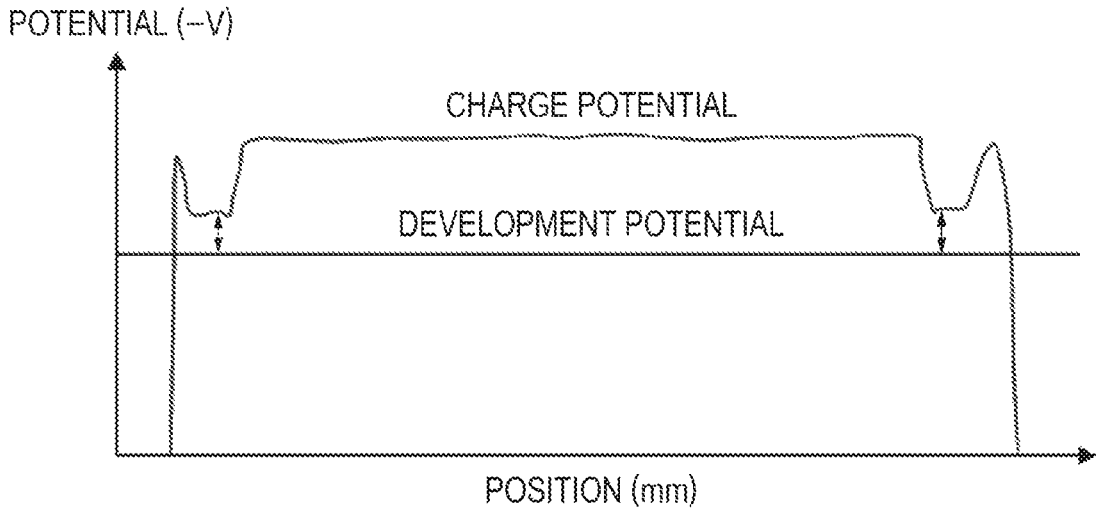
FIGS. 4A and 4B illustrate an example of charge potential in a state where ends of a photoconductor drum are unevenly abraded, FIG. 4A illustrating a state where electrostatic charging is performed by using a first charging unit, FIG. 4B illustrating a state where electrostatic charging is performed by using an auxiliary charging unit.
Figure 4B:
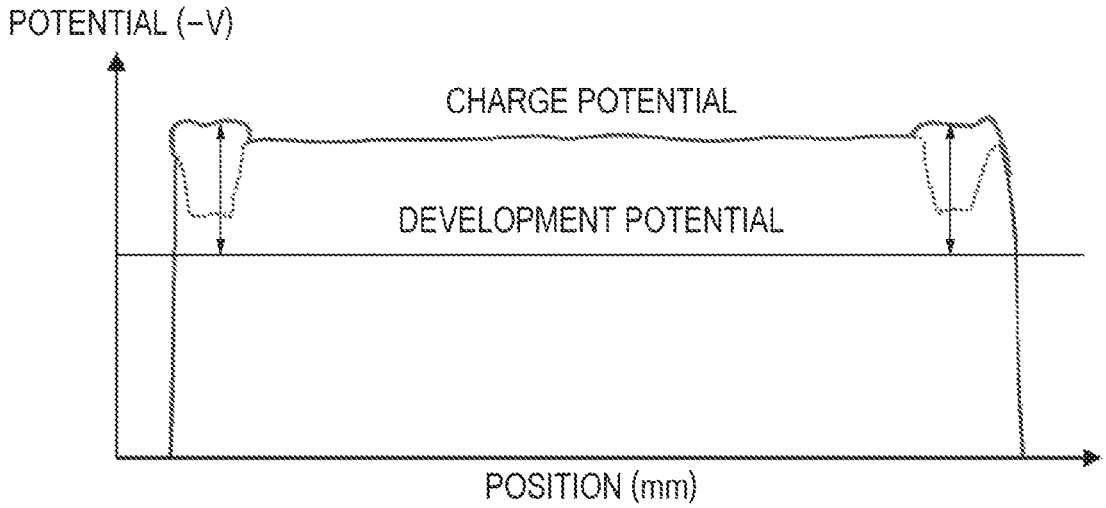

FIGS. 4A and 4B illustrate an example of charge potential in a state where the ends of the photoconductor drum PR are unevenly abraded. Specifically, FIG. 4A illustrates a state where electrostatic charging is performed by using the first charging unit 1, and FIG. 4B illustrates a state where electrostatic charging is performed by using the auxiliary charging unit 11.

In the graphs shown in FIGS. 4A and 4B, the abscissa axis denotes the position in the width direction of the photoconductor drum PR, and the ordinate axis denotes the electric potential.

When the ends of the photoconductor drum PR abrade unevenly, the charge potential in the end regions (L2–L1) is lower than in the passing region L1 even when electrostatic charging is performed by using a charging device in the related art not having the auxiliary charging unit 11, as shown in FIG. 4A. In other words, a charge defect occurs. Moreover, this decrease in the charge potential becomes larger as the abrasion progresses.

When printing is performed on a maximum-size recording sheet S in this state, a potential difference at the developing device G decreases in the end regions (L2–L1). Therefore, a phenomenon in which a large amount of developer transfers toward the photoconductor drum PR, that is, an image quality defect called fog, occurs.

In contrast, in the first exemplary embodiment, the auxiliary charging unit 11 is disposed in correspondence with the end regions (L2–L1), and electrostatic charging is performed using an auxiliary charge bias. Therefore, the charge potential in the end regions (L2–L1) may be set to be about the same as that in the mid region (L1), as shown in FIG. 4B, thereby suppressing the occurrence of an image quality defect.

Furthermore, in the first exemplary embodiment, the auxiliary charge bias to be applied to the auxiliary charging unit 11 is set so as to increase over time. Therefore, the occurrence of an image quality defect may be temporally suppressed.

In the first exemplary embodiment, the auxiliary charging unit 11 receives an auxiliary charge bias even when a small-width sheet recording sheet S (such as an A4-size sheet) is used. Regions where a charge defect may occur are the end regions (L2–L1), which are outside the image region in a case where a small-width sheet S is used. However, the recording sheets S may vary in size or may become displaced in the width direction during the transport process, sometimes resulting in fog, such as contamination, being transferred to the edges. Although it is possible to employ a configuration that applies an auxiliary charge bias only when a maximum-size recording sheet S is used, it is desirable to apply an auxiliary charge bias also when a small-width recording sheet S is used.

Furthermore, the first charging unit 1 and the auxiliary charging unit 11 in the first exemplary embodiment are both constituted of scorotrons. Therefore, the photoconductor drum PR may be stably charged even when the photoconductor drum PR rotates at high speed, as compared with a case where a charging roller serving as a contact-type charging member is used.

In the first exemplary embodiment, an auxiliary charge bias is set by estimating the degree of degradation in the end regions of the photoconductor drum PR based on the accumulative number of prints. Alternatively, the bias to be applied to the auxiliary charging unit 11 may be increased with increasing time (i.e., increasing number of times) in which the overlapping end regions (L2–L1) of the photoconductor drum PR face the transfer roller TR without the recording sheet S interposed therebetween and the electric current from the transfer roller TR is applied to the photoconductor drum PR. As an indicator used for estimating the time in which the electric current flows directly to the photoconductor drum PR from the transfer roller TR without the intervention of the recording sheet S, for example, any variable, index, or parameter with which the degree of degradation in the end regions of the photoconductor drum PR may be estimated, such as the accumulative number of rotations of the photoconductor drum PR and the accumulative write amount of the exposure device ROS in addition to the accumulative number of prints, may be used, or a combination of the above may be used.

Furthermore, for example, on the surface of the photoconductor drum PR, a surface electrometer as an example of a measuring member may be disposed at positions corresponding to the overlapping regions (L2–L1), and another surface electrometer may be disposed in the mid region in the width direction as an example of an inner region of the passing region L1 of a small-width recording sheet S. By using these surface electrometers to measure the surface potentials and calculating the auxiliary charge bias from the potential difference between these surface potentials, an auxiliary charge bias that increases with increasing potential difference may be applied. With such a configuration, the degradation of the surface of the photoconductor drum PR may be directly measured instead of being estimated, whereby a more appropriate auxiliary charge bias may be applied, as compared with a case where the degradation is estimated.

The measurement process at the surface electrometers may be performed during the image forming operation or may be performed when the power is turned on, during recovery from a sleep state, during an image-density adjustment operation, or when an image forming operation is not being performed, such as immediately upon completion of an image forming operation.

Second Exemplary Embodiment

Next, a second exemplary embodiment of the present invention will be described. In the description of the second exemplary embodiment, components corresponding to the components in the first exemplary embodiment are given the same reference signs, and detailed descriptions thereof are omitted.

The second exemplary embodiment differs from the first exemplary embodiment with regard to the following points, but is similar to the first exemplary embodiment with regard to other points.

Figure 5:
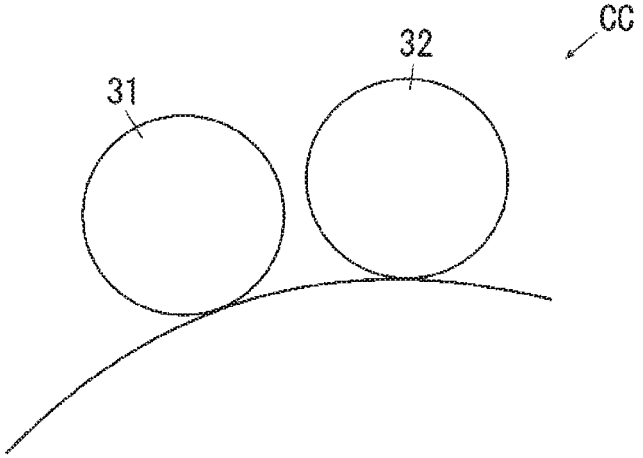
FIG. 5 illustrates a charging device according to a second exemplary embodiment and corresponds to FIG. 2 in the first exemplary embodiment.

FIG. 5 illustrates a charging device according to the second exemplary embodiment and corresponds to FIG. 2 in the first exemplary embodiment.

Figure 6:
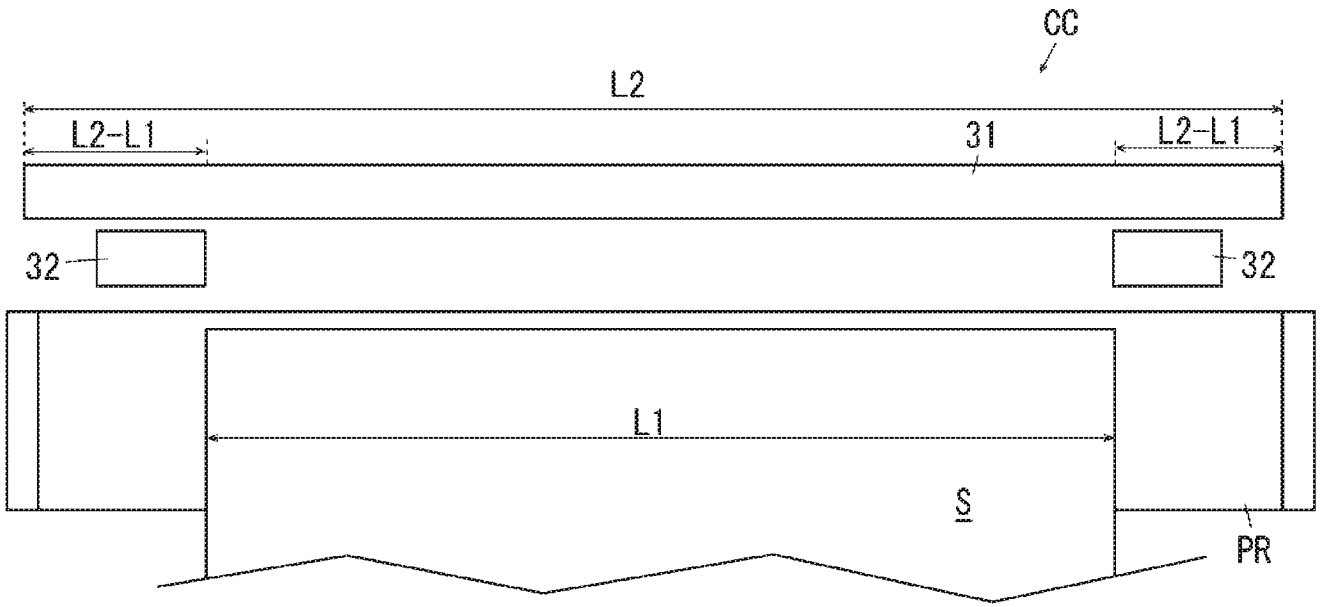
FIG. 6 illustrates the charging device according to the second exemplary embodiment and corresponds to FIG. 3 in the first exemplary embodiment.

FIG. 6 illustrates the charging device according to the second exemplary embodiment and corresponds to FIG. 3 in the first exemplary embodiment.

Referring to FIGS. 5 and 6, in the charging device CC according to the second exemplary embodiment, a first charging roller 31 is used as an example of a first charging unit. Furthermore, in the second exemplary embodiment, an auxiliary charging roller 32 is used as an example of a second charging unit. The auxiliary charging roller 32 is disposed only in regions corresponding to the end regions (L2–L1).

Operation of Second Exemplary Embodiment

In the charging device CC according to the second exemplary embodiment having the above-described configuration, a charge defect at the ends (L2–L1) may be suppressed by the roller-shaped charging units 31 and 32, as compared with a configuration not having the auxiliary charging roller 32.

Furthermore, in contrast to the first exemplary embodiment, the charging rollers 31 and 32 are used in the charging device CC according to the second exemplary embodiment so that the manufacturing costs may be reduced and ozone may be reduced at the time of discharge, as compared with a case where scorotrons are used.

Third Exemplary Embodiment

Next, a third exemplary embodiment of the present invention will be described. In the description of the third exemplary embodiment, components corresponding to the components in the first exemplary embodiment are given the same reference signs, and detailed descriptions thereof are omitted.

The third exemplary embodiment differs from the first exemplary embodiment with regard to the following points, but is similar to the first exemplary embodiment with regard to other points.

Figure 7:
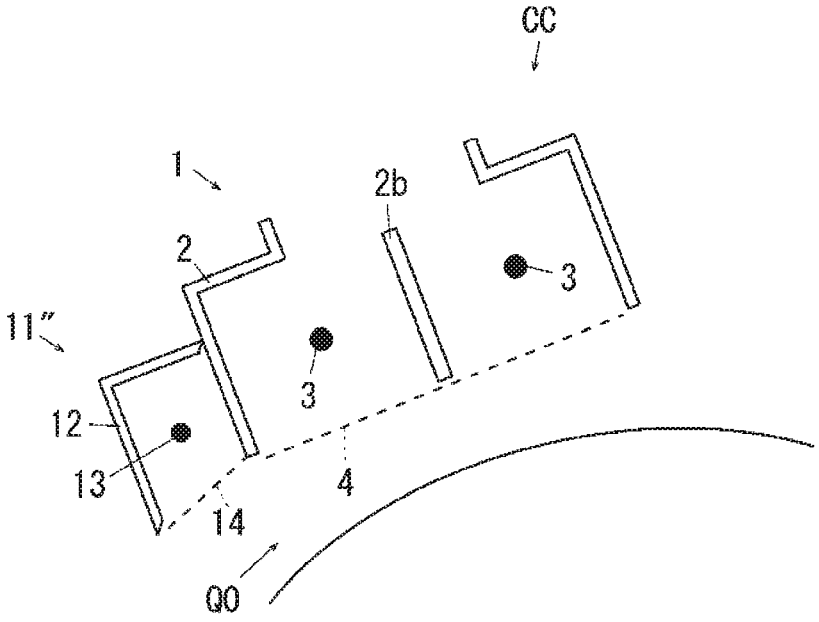
FIG. 7 illustrates a charging device according to a third exemplary embodiment and corresponds to FIG. 2 in the first exemplary embodiment.

FIG. 7 illustrates a charging device according to the third exemplary embodiment and corresponds to FIG. 2 in the first exemplary embodiment.

Figure 8:
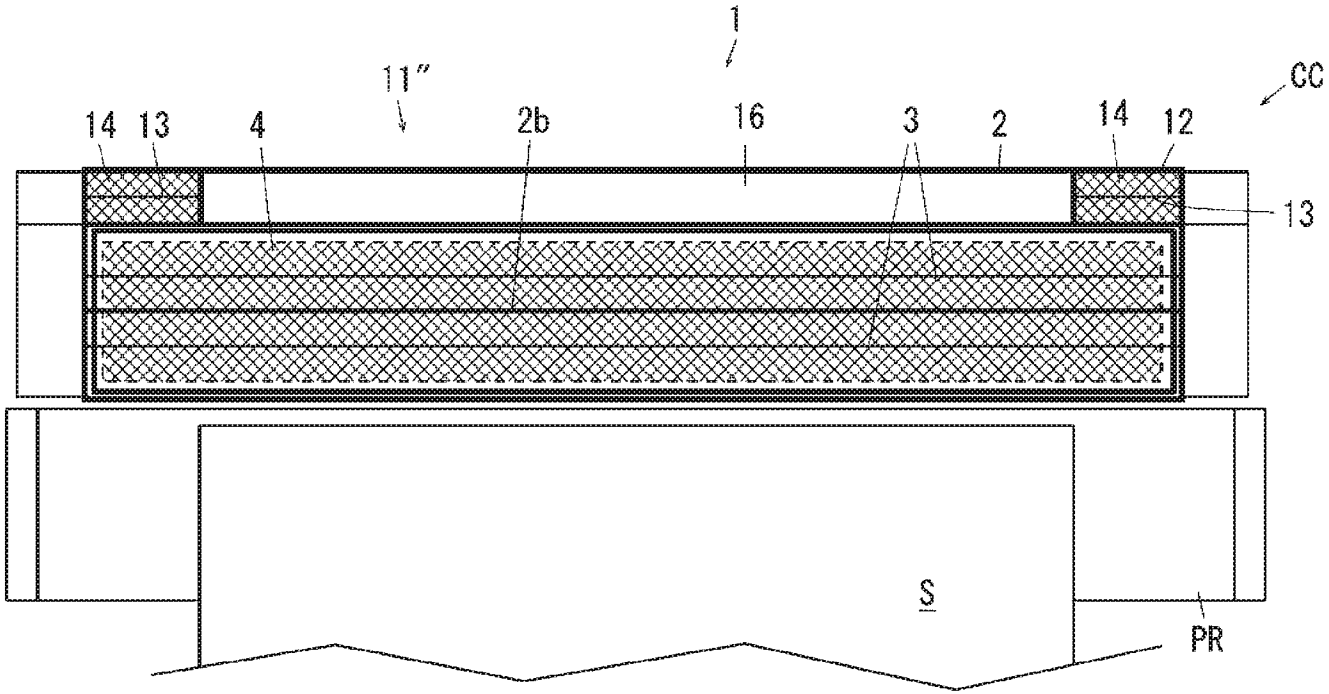
FIG. 8 illustrates the charging device according to the third exemplary embodiment and corresponds to FIG. 3 in the first exemplary embodiment.

FIG. 8 illustrates the charging device according to the third exemplary embodiment and corresponds to FIG. 3 in the first exemplary embodiment.

Referring to FIGS. 7 and 8, the charging device CC according to the third exemplary embodiment differs from that in the first exemplary embodiment in that an auxiliary charging unit 11" is disposed upstream of the first charging unit 1 in the rotational direction of the photoconductor drum PR.

Operation of Third Exemplary Embodiment

Figure 9A:
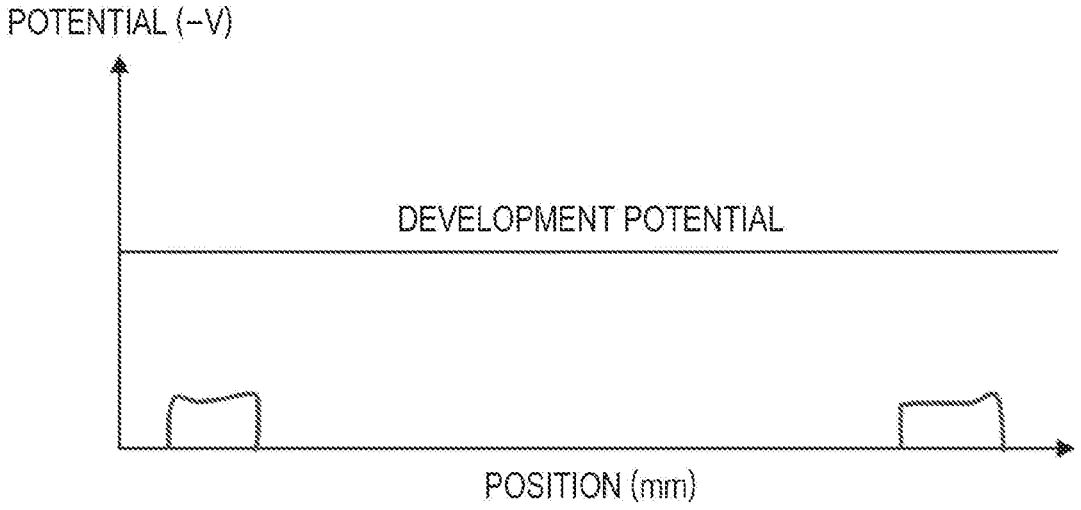
FIGS. 9A and 9B illustrate an example of charge potential in a state where the ends of the photoconductor drum are unevenly abraded, FIG. 9A illustrating a state where electrostatic charging is performed by using the auxiliary charging unit, FIG. 9B illustrating a state where electrostatic charging is performed by using the first charging unit after the electrostatic charging by the auxiliary charging unit.
Figure 9B:
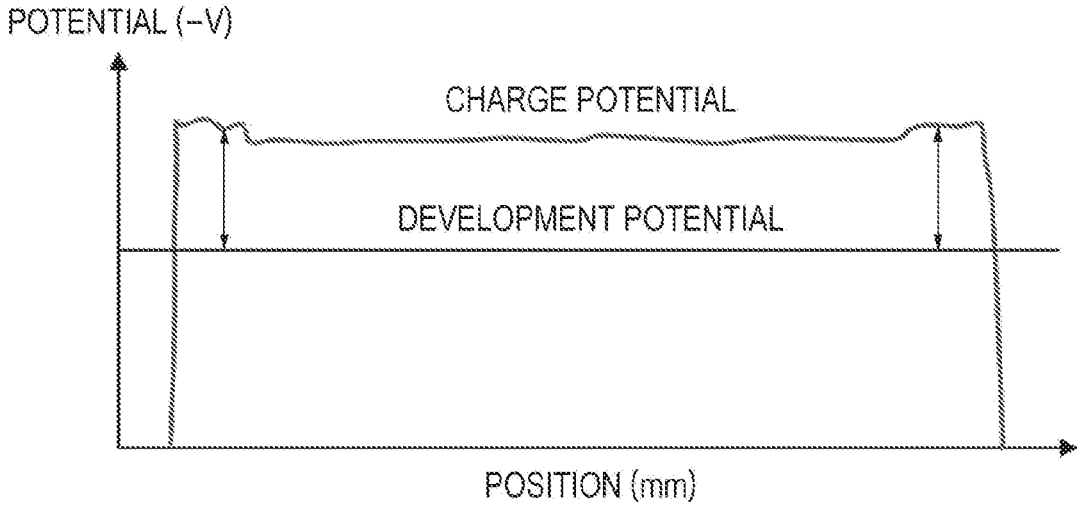

FIGS. 9A and 9B illustrate an example of charge potential in a state where the ends of the photoconductor drum PR are unevenly abraded. Specifically, FIG. 9A illustrates a state where electrostatic charging is performed by using the auxiliary charging unit 11", and FIG. 9B illustrates a state where electrostatic charging is performed by using the first charging unit 1 after the electrostatic charging by the auxiliary charging unit 11".

In the charging device CC according to the third exemplary embodiment having the above-described configuration, the end regions (L2–L1) of the photoconductor drum PR are first electrostatically charged by the auxiliary charging unit 11", as shown in FIG. 9A, and the entire region L2 is subsequently electrostatically charged by the first charging unit 1. Therefore, when electrostatic charging is performed by the first charging unit 1, the entire region L2 including the already-charged end regions (L2–L1) is electrostatically charged, so that unevenness is likely to be suppressed at the boundaries between the end regions (L2–L1) and the mid region L1, as compared with the case in FIGS. 4A and 4B in the first exemplary embodiment. Consequently, an adverse effect on the image quality caused by the uneven charge potential may be suppressed. Moreover, by using a so-called scorotron having a grid electrode 4 as the first charging unit 1, unevenness is more likely to be suppressed at the boundaries between the end regions (L2–L1) and the mid region L1, as compared with a so-called corotron not having a grid electrode 4.

Fourth Exemplary Embodiment

Next, a fourth exemplary embodiment of the present invention will be described. In the description of the fourth exemplary embodiment, components corresponding to the components in the first and third exemplary embodiments are given the same reference signs, and detailed descriptions thereof are omitted.

The fourth exemplary embodiment differs from the first and third exemplary embodiments with regard to the following points, but is similar to the first exemplary embodiment with regard to other points.

Figure 10:
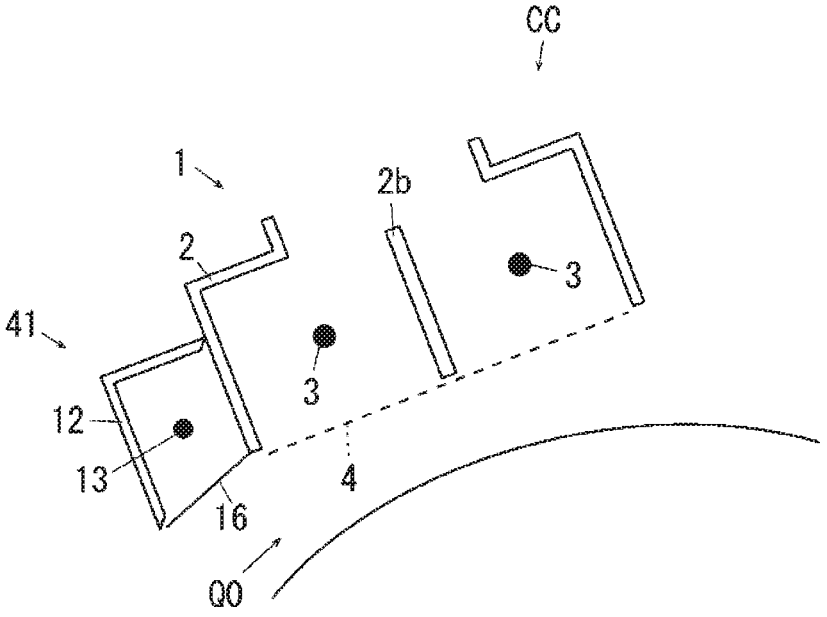
FIG. 10 illustrates a charging device according to a fourth exemplary embodiment and corresponds to FIG. 2 in the first exemplary embodiment.

FIG. 10 illustrates a charging device according to the fourth exemplary embodiment and corresponds to FIG. 2 in the first exemplary embodiment.

Figure 11:
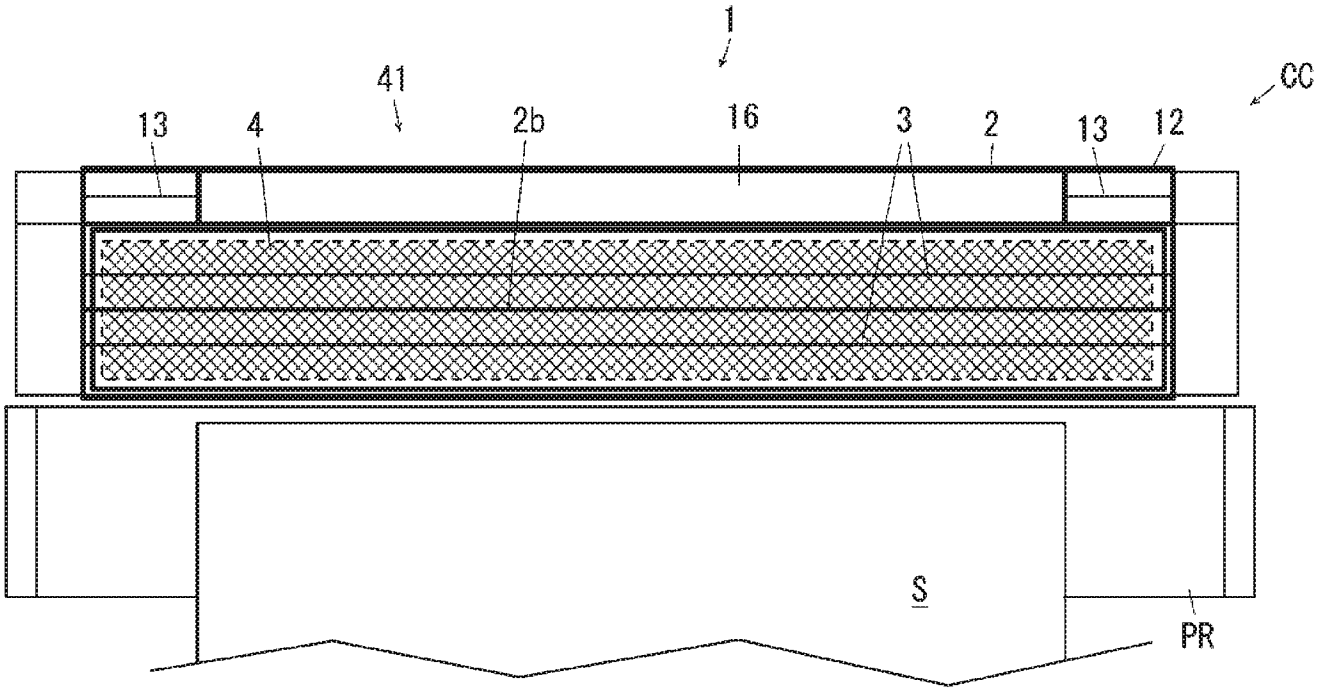
FIG. 11 illustrates the charging device according to the fourth exemplary embodiment and corresponds to FIG. 3 in the first exemplary embodiment.

FIG. 11 illustrates the charging device according to the fourth exemplary embodiment and corresponds to FIG. 3 in the first exemplary embodiment.

Referring to FIGS. 10 and 11, the charging device CC according to the fourth exemplary embodiment is similar to that in the third exemplary embodiment in that an auxiliary charging unit 41 is disposed upstream of the first charging unit 1. Furthermore, the charging device CC according to the fourth exemplary embodiment differs from that in the third exemplary embodiment in that the auxiliary charging unit 41 has an auxiliary shield 12, an auxiliary discharge wire 13, and a cover plate 16 but does not have an auxiliary grid electrode 14. Specifically, the auxiliary charging unit 41 according to the fourth exemplary embodiment is constituted of a so-called corotron.

Operation of Fourth Exemplary Embodiment

Figure 12A:
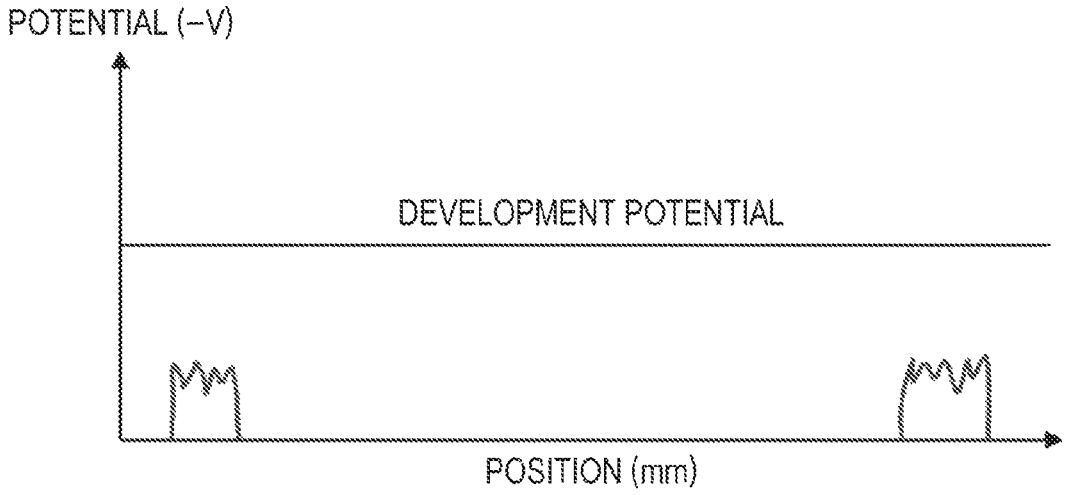
FIGS. 12A and 12B illustrate an example of charge potential in a state where the ends of the photoconductor drum are unevenly abraded, FIG. 12A illustrating a state where electrostatic charging is performed by using the auxiliary charging unit, FIG. 12B illustrating a state where electrostatic charging is performed by using the first charging unit after the electrostatic charging by the auxiliary charging unit.
Figure 12B:
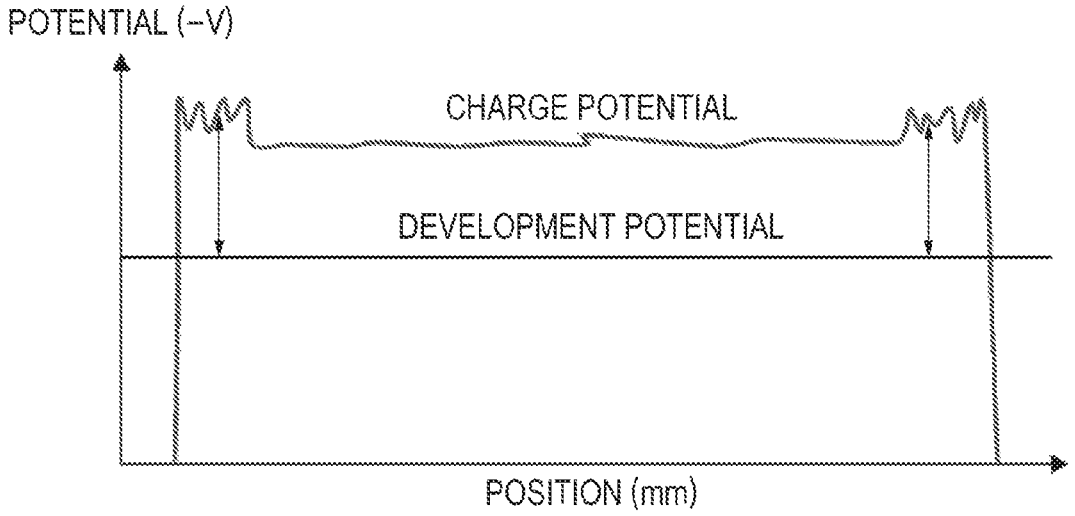

FIGS. 12A and 12B illustrate an example of charge potential in a state where the ends of the photoconductor drum PR are unevenly abraded. Specifically, FIG. 12A illustrates a state where electrostatic charging is performed by using the auxiliary charging unit 41, and FIG. 12B illustrates a state where electrostatic charging is performed by using the first charging unit 1 after the electrostatic charging by the auxiliary charging unit 41.

In the charging device CC according to the fourth exemplary embodiment having the above-described configuration, the end regions (L2–L1) of the photoconductor drum PR are electrostatically charged by the auxiliary charging unit 41, as shown in FIG. 12A, and the entire region L2 is subsequently electrostatically charged by the first charging unit 1. Therefore, in the fourth exemplary embodiment, the charge potential tends to become uneven in the end regions (L2–L1), as compared with the third exemplary embodiment, but is evened out to some extent from a charge region Q0 to an exposure region Q1 and then to a development region Q2 in accordance with self-discharge. By using a so-called scorotron having a grid electrode 4 as the first charging unit 1, the effect of evening out the uneven charge potential in the end regions (L2–L1) may be increased, as compared with a case where so-called corotrons are used both as the first charging unit 1 and the auxiliary charging unit 41. Furthermore, if the end regions (L2–L1) are set as marginal regions on a printed recording sheet S and are to be cut off in accordance with, for example, specifications of the copier U, there is little problem even if the image quality decreases. In the fourth exemplary embodiment, a corotron not having an auxiliary grid electrode 14 is used so that the manufacturing costs may be reduced, as compared with a case where a scorotron having an auxiliary grid electrode 14 is used.

Modifications

Although the exemplary embodiments of the present invention have been described in detail above, the present invention is not to be limited to the above exemplary embodiments and permits various modifications within the technical scope of the invention defined in the claims. Modifications H01 to H06 will be described below.

In a first modification H01, the image forming apparatus according to each of the above exemplary embodiments is not limited to the copier U, and may be, for example, a printer, a facsimile apparatus, or a multifunction apparatus having multiple functions or all functions of such apparatuses.

The copier U according to each of the above exemplary embodiments is configured to use a single-color developer. Alternatively, for example, in a second modification H02, each exemplary embodiment may also be applied to a multicolor image forming apparatus that uses two or more colors.

In a third modification H03, the first to fourth exemplary embodiments may be combined. For example, in accordance with the desired image quality, design, and specifications, the first charging unit may be constituted of a scorotron or a corotron and the auxiliary charging unit may be constituted of a charging roller, or the first charging unit may be constituted of a charging roller and the auxiliary charging unit may be constituted of a scorotron or a corotron. As another alternative, the first charging unit and the auxiliary charging unit may both be constituted of corotrons.

In each of the above exemplary embodiments, it is desirable to use a configuration that increases the auxiliary charge bias over time. Alternatively, in a fourth modification H04, a configuration that does not change the auxiliary charge bias is also possible.

In a fifth modification H05, the specific materials exemplified in each of the above exemplary embodiments may be changed, where appropriate, in accordance with the design and specifications.

In each of the above exemplary embodiments, an auxiliary charging unit is provided in correspondence with the non-passing regions of an A4-size recording sheet, which is assumed to be the most frequently used recording sheet. Alternatively, in a sixth modification H06, for example, if it is assumed that multiple frequently-used recording sheets may be used, multiple auxiliary charging units may be provided in correspondence with the respective non-passing regions.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a first charging unit that electrostatically charges a surface of an image bearing member that comes into contact with a medium onto which an image is to be ultimately transferred, the first charging unit being disposed in correspondence with an entire region of the image bearing member in a first scanning direction; and a second charging unit disposed in correspondence with an overlapping region where a non-passing region of a small-width medium and a passing region of a maximum-usable-width medium overlap when viewed in the first scanning direction, the small-width medium having a width smaller than a maximum usable width of the maximum-usable-width medium, the second charging unit electrostatically charging the overlapping region, wherein a bias to be applied to the second charging unit is increased each time an accumulative number of prints of the small-width medium increases, and wherein the second charging unit has a cover that extends only along a passing region of the small-width medium and is connected to ground.

2. The charging device according to claim 1, wherein the second charging unit is disposed upstream of the first charging unit in a rotational direction of the image bearing member.

3. The charging device according to claim 2, wherein the first charging unit has a string-shaped discharging member and an electrode that is disposed between the string-shaped discharging member and the image bearing member and that receives a voltage between the discharging member and the electrode, the first charging unit electrostatically charging the image bearing member in a noncontact manner.

4. An image forming apparatus comprising:

an image bearing member;

the charging device according to claim 1 that electrostatically charges the surface of the image bearing member;

a latent-image forming device that forms a latent image on the electrostatically-charged image bearing member;

a developing device that develops the latent image into a visible image; and a transfer device that transfers the visible image onto a medium that comes into contact with the image bearing member.

5. A charging device comprising:

first charging means that electrostatically charges a surface of an image bearing member that comes into contact with a medium onto which an image is to be ultimately transferred, the first charging means being disposed in correspondence with an entire region of the image bearing member in a first scanning direction; and second charging means disposed in correspondence with an overlapping region where a non-passing region of a small-width medium and a passing region of a maximum-usable-width medium overlap when viewed in the first scanning direction, the small-width medium having a width smaller than a maximum usable width of the maximum-usable-width medium, the second charging means electrostatically charging the overlapping region, wherein a bias to be applied by the second charging means is increased each time an accumulative number of prints of the small-width medium increases, and wherein the second charging means has a cover that extends only along a passing region of the small-width medium and is connected to ground.

* * * * *